US008376489B2

(12) United States Patent
Puigardeu et al.

(10) Patent No.: US 8,376,489 B2
(45) Date of Patent: Feb. 19, 2013

(54) RECOVERY PRINT MODE

(75) Inventors: Sergio Puigardeu, Barcelona Barcelona (ES); Luis Garcia, Les Roquetes Barcelona (ES); M. Isabel Borrell, Barcelona Manresa (ES); Ángel Martinez, Barcelona Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 162 days.

(21) Appl. No.: 13/077,438

(22) Filed: Mar. 31, 2011

(65) Prior Publication Data

US 2012/0249631 A1 Oct. 4, 2012

(51) Int. Cl.
*B41J 29/38* (2006.01)

(52) U.S. Cl. ..... 347/9; 347/14; 347/19

(58) Field of Classification Search ..... 347/9, 12, 347/13, 14, 19, 20, 40, 42
See application file for complete search history.

(56) References Cited

U.S. PATENT DOCUMENTS

| | | | | |
|---|---|---|---|---|
| 6,030,072 | A | 2/2000 | Silverbrook | |
| 6,231,251 | B1 | 5/2001 | Clark | |
| 6,439,681 | B1 * | 8/2002 | McClellan | 347/14 |
| 7,168,782 | B2 * | 1/2007 | Koitabashi et al. | 347/19 |
| 7,278,699 | B2 | 10/2007 | Drake et al. | |
| 7,866,788 | B2 | 1/2011 | Jorba et al. | |
| 2008/0266343 | A1 | 10/2008 | Borrell et al. | |
| 2009/0091596 | A1 | 4/2009 | Askeland | |
| 2009/0128594 | A1 | 5/2009 | Martinez et al. | |
| 2010/0142977 | A1 | 6/2010 | Bettiol | |
| 2010/0174399 | A1 | 7/2010 | Silverbrook | |
| 2010/0303281 | A1 | 12/2010 | Wu et al. | |

FOREIGN PATENT DOCUMENTS

WO WO-2010071644 A1 6/2010

OTHER PUBLICATIONS

Chee, Chin Lee, et al.; "Detecting and Removing Fibers"; U.S. Appl. No. 12/641,084 filed Dec. 17, 2009.
Fact Sheet; "HP Designjet L65500 Printer", May 2008; 6 pages.
Puigardeu, Sergio, et al.; "Inkjet Printing Apparatus and Method for Printing a Plurality of Pixels"; U.S. Appl. No. 12/789,808; filed May 28, 2010.

* cited by examiner

*Primary Examiner* — Juanita D Jackson
(74) *Attorney, Agent, or Firm* — Garry A. Perry

(57) ABSTRACT

In one embodiment, first printing is caused in response to a print job, applying ink upon a media utilizing a first row of printheads and a second row of printheads. The first row of printheads includes a plurality of printhead types. The second row of printheads is adjacent to the first row and includes at least one printhead of each of types. Failure of a first printhead within the first row is detected. The status of printheads included within the second row is analyzed. Second printing is caused applying ink upon the media utilizing the second row of printheads, and not the first row of printheads, in response to determining that printheads within the second row are operable to complete the print job.

20 Claims, 7 Drawing Sheets

RECOVERY PRINT MODE

BACKGROUND

Inkjet printers use one or more printheads provided with a number of nozzles from which ink droplets are fired or ejected onto a media. The printer controls the firing of ink from the nozzles to create on the media a pattern of dots corresponding to the desired image. By controlling the timing, placement and volume of inkjet output droplets, reliable, repeatable character performance and graphic performance is achieved.

BRIEF DESCRIPTION OF THE DRAWINGS

The accompanying drawings illustrate various embodiments and are a part of the specification. The illustrated embodiments are merely examples and do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

The nozzles of an inkjet printhead are typically arranged in one or more linear arrays, with the length of the nozzle arrays impacting the size of a swath of ink that the printhead can lay down upon the media in a single pass. For purposes of this specification and the appended claims, a "swath size" means a measurement or estimate of the extent of the distribution of ink from a printhead or printheads onto a media. One approach to increasing the speed of inkjet printing is to utilize multiple printheads positioned on a single carriage, print bar or other printhead holding structure. In this manner, the nozzle arrays of the multiple printheads can be functionally combined to create a swath. This approach is sometimes referred to as "combined swath printing".

Combined swath technology allows printing at advanced speeds relative to printing speeds experienced when printing at lesser swath sizes. However, increasing the number of printheads utilized increases the probability of a printhead failure. Possible printhead failures include dogging of nozzles due to dried ink or contaminants becoming lodged in the nozzle orifices, burnt resistors, and/or insufficient backpressure within the printhead. When a printhead failure occurs, the printing process for a print job can be unexpectedly interrupted and result in wasted supplies (e.g. ink and media associated with a cancelled print job), wasted time (e.g., time associated with repeating a print job), and/or missed delivery dates. Embodiments described below were developed in an effort to provide a method and a system to print in a recovery mode that allows continuing printing of a print job by a printer utilizing combined swath printing even when one or more printheads are failing. User satisfaction with combined swath printing is increased as users can schedule large print jobs with increased confidence that a print job may be completed notwithstanding the occurrence of a printhead failure.

The embodiments shown in the accompanying drawings and described below are non-limiting examples. Other embodiments are possible and nothing in the accompanying drawings or in this Detailed Description of Embodiments should be construed to limit the scope of the disclosure, which is defined in the Claims.

The following description is broken into sections. The first section, labeled "Components", describes various physical and logical components utilized to implement various embodiments and environments in which the embodiments may be implemented. The second section, labeled as "Operation", describes example embodiments of a method to print in a recovery mode. The third section, labeled "Examples", describes examples of a recovery print mode, according to embodiments of the disclosure.

Figure 1:
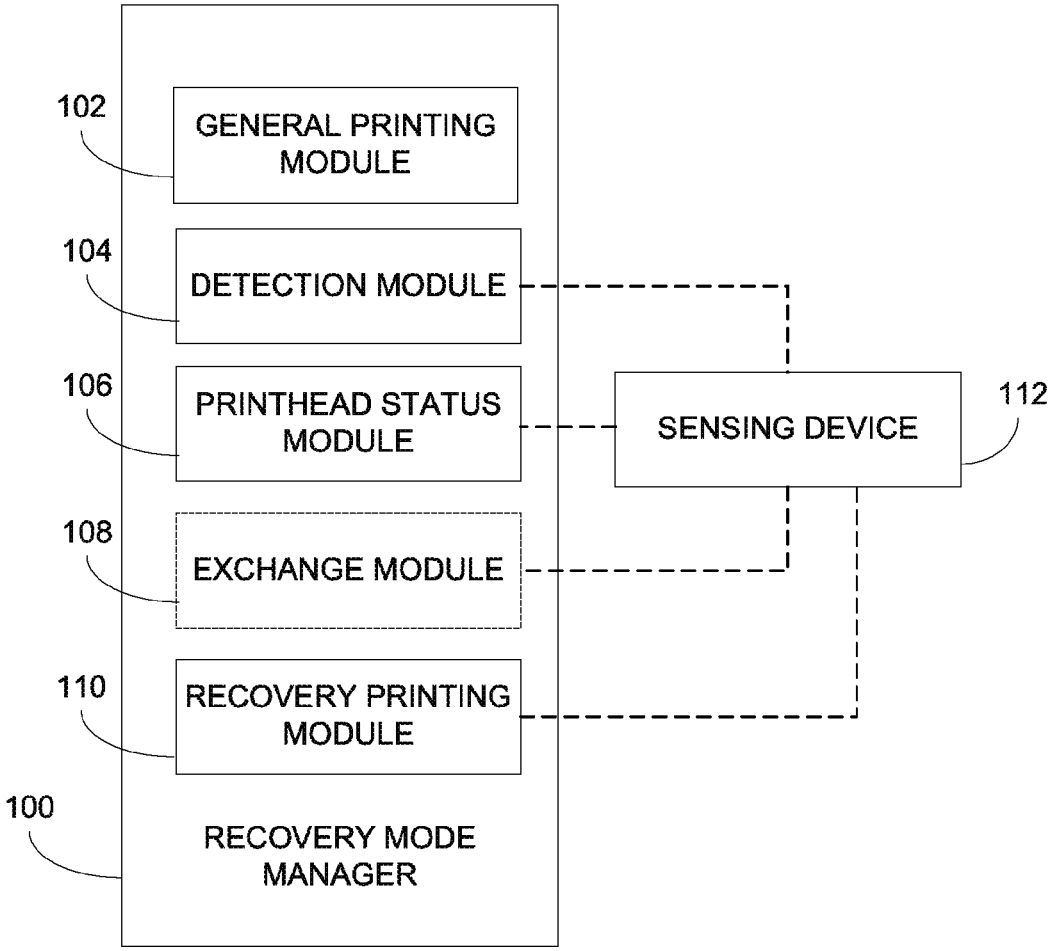
FIG. 1 depicts the physical and logical components of a recovery mode manager according to an embodiment.

COMPONENTS: FIG. 1 is an example block diagram illustrating the physical and logical components of a recovery mode manager 100. Recovery mode manager 100 represents generally any combination of hardware and programming configured for use to print in a recovery mode. Recovery mode manager 100 may be implemented in a number of environments, such as environment 200 of FIG. 2 and environment 300 of FIG. 3. In the example of FIG. 1, recovery mode manager 100 is shown to include a general printing module 102, detection module 104, printhead status module 106, exchange module 108, and recovery printing module 110.

General printing module 102 represents generally any combination of hardware and programming configured to cause first printing upon a media in response to a print job, applying ink upon a media utilizing a first row and a second row of printheads. As used in this specification and the appended claims, media means any object that can be printed upon, including but not limited to paper media. As used in this specification and the appended claims, "ink" means any fluid used for printing including but not limited to aqueous inks, solvent inks, UV-curable inks, dye sublimation inks and latex inks. As used in this specification and the appended claims, a "print job" means one or more images submitted to be printed. In examples, an image may be submitted to be printed as a document or file and in a variety of document and/or file formats. The print job may be received utilizing a networking protocol, including but not limited to Transmission Control Protocol/Internet Protocol ("TCP/IP"), HyperText Transfer Protocol ("HTTP"), Simple Mail Transfer Protocol ("SMTP"), Extensible Messaging and Presence Protocol ("XMPP") and/or Session Initiation Protocol ("SIP"). In examples, the sending computing device may be desktop, laptop, or mobile computing device that is connected to the web, the sending initiated by a user at a user interface included in such device. In another example, the print job may originate at a web enabled printer. For example, a user may send a print job via a printer application accessible at a control panel of a first web enabled printer, which results in the print job being received at the general printing module 102.

The print job is caused to print utilizing a first and a second row of printheads. The first row of printheads includes a plurality of printhead types. The second row of printheads is adjacent to the first row, and includes at least one printhead of each of the types present in the first row. In an embodiment, the first and second rows of printheads are located on a same printhead holding structure. In an embodiment, the holding structure that holds the first and second rows of printheads is a printhead carriage movably mounted on a slider rod and configured to move across a media during a printing operation. In another embodiment, the holding structure that holds the first and second rows of printheads is a stationary print bar. In an embodiment, the holding structure may include a page-wide-array configuration of printheads, wherein the printheads may be configured to span an entire media width during a printhead carriage across media, or pass of the media beneath a stationary print bar.

For purposes of this specification and the appended claims, a printhead "type" means a category or kind of printhead that has a readily defined characteristic. In a first example, a color inkjet printer may be provided with a plurality of printheads, with each printhead emitting one of the colors black, cyan, yellow, or magenta. It can be said in this example that the black, cyan, yellow, and magenta printheads are each a different "type" of printhead. In another embodiment of an inkjet printer, a printhead type may include a printhead that emits a specific combination of colors. In a second example a first printhead type that emits cyan and black, a second printhead type that emits magenta and yellow, and a third printhead type that emits light cyan and light magenta. In this second example, each of the cyan/black, magenta/yellow and light cyan/light magenta printheads is a different "type" printhead. Thus, in embodiments each of the printhead types included in the first and second rows emits ink of a different color, or combination of colors. In an embodiment, each of the printhead types included in the first and second rows emits ink of a different color, or combination of colors. In other embodiments, the type of printhead is characterized by a printhead feature or attribute other than colors emitted, including, but not limited to the number of nozzles or nozzle arrays, the length of nozzle arrays, and nozzle diameters.

In an embodiment, the second row of printheads includes printheads that are arranged in the same order as the printheads of the first row, according to type of printhead. For example, if the printheads in the first row are in the type order of "black, cyan, yellow, magenta" viewed left to right, the black, cyan, yellow and magenta type printheads of the second row are likewise positioned in the type order "black, cyan, yellow, magenta" viewed left to right. In an embodiment, the printheads are positioned on the holding structure such that the nozzle arrays of printheads of the first row overlap with nozzle arrays of a same type printheads in the second row, thereby allowing for the functional combination of multiple printheads of the same type during printing.

Detection module 104 represents generally any combination of hardware and programming configured to detect failure of a first printhead within the first row. For purposes of this specification and the appended claims, a "failure" means an inability to meet a performance standard. "Failure", "failed", and "inoperable" are used synonymously in this application. Detecting a failure may comprise utilizing nozzle health information gathered from a sensing device 112 included within the printer. In an embodiment, the detection module connects to a sensing device 112, and the detection module is operable to receive information from the sensing device 112 identifying blocked nozzles within a printhead.

In an embodiment, the sensing device 112 includes a drop detector. As used in this specification, "drop detector" means a device that is operable to detect the presence or size or quantity of drops of ink or other liquid. In an embodiment, the drop detector may employ piezo-electric material and associated circuitry which detects the impact of the ink drops hitting the detection station and thereby detects the ejection of ink drops from a printhead. In an embodiment, the drop detector may be an optical detector that includes a light source and a light detector. An inkjet nozzle may be aimed so that the ink drops pass between the light source and the light detector and occlude light rays that travel between the light source and the detector. In an embodiment, the drop detector is an electrostatic drop detector. In an example, the electrostatic drop detector may be configured such that as the printhead fires ink drops, a charge plate at the top of the sensor assembly induces an electrostatic charge in the drops. When charged drops fly past the sensor the drops induce an electrical charge on the sensor. Condition of the printhead nozzles, e.g., healthy or missing, may be determined by detecting the charges of the drops. In an embodiment, the sensing device 112 may be a sensor configured to detect ink pressure levels within components of a printhead, allowing for identification of blocked nozzles and other determinations of printhead condition.

Printhead status module 106 represents generally any combination of hardware and programming configured to analyze status of printheads included within the second row. In an embodiment, analysis of the status of the second row printheads is performed utilizing the same sensing device 112 or devices that communicated information to detection module 104. In other embodiments, a different sensing device or different set of devices may be utilized to analyze the second row printheads than the sensing device or devices utilized to detect the failed printhead in the first row. For example, status of the second row printheads may be analyzed utilizing a plurality of sensing devices, each to measure ink pressure level within a specific printhead, wherein the sensing device utilized to detect failures within the first row of printheads is a drop detector.

In an embodiment, recovery mode manager includes an exchange module 108. Exchange module 108 represents generally any combination of hardware and programming configured to cause an exchange of a second printhead in the second row and a third printhead in the first row in response to detecting the second printhead is failed and that the third printhead is healthy and of the same type as the second printhead. For purposes of this specification and the appended claims, "healthy" means meeting a performance standard. "Healthy", "operable", and "operating" are used synonymously in this application. The combination of the functionality of the detection module 104, printhead status module 106 and exchange module 108 affords an ability to complete a print job in a recovery mode that utilizes the second row, despite the fact that there was a printhead failure within the first row (the first printhead) and the second row (the second printhead). Exchanging the failed printhead in the second row with a healthy like kind printhead from the first row enables recovery mode printing to take place by rending all of the printheads in the second row operable to complete the print job. In an embodiment, detecting the second printhead is failed and that the third printhead is healthy and of the same type as the second printhead may utilize the same sensing device 112 or devices that communicated information to detection module 104 and/or the printhead status module. In an embodiment, the exchange may be caused by sending an instruction to a user via a display device, the instruction detailing the printhead exchange to be made. In another embodiment, the exchange may be caused to occur automatically, via the exchange module communicating with and/or acting in concert with a printhead exchange mechanism that automatically exchanges the second and third printheads.

Recovery printing module 110 represents generally any combination of hardware and programming configured to cause second printing upon the media to continue printing of the print job, utilizing the second row of printheads, and not the first row, in response to determining that printheads within the second row are operable to complete the print job. In an embodiment, determining that printheads within the second row are operable to complete the print job comprises determining that the second row has no inoperable printheads. In another embodiment, determining that the printheads within the second row are operable to complete the print job includes determining that the second row has operating printheads including at least one of each of the types. In an example, if the print job is a color print job and the first and second rows of printheads each contain one "cyan" type printhead, one "yellow" type printhead, and one "magenta" type printhead, the recovery printing module may confirm that each of the cyan, yellow, and magenta printheads are operable prior to completing the print job. In another embodiment, it may be determined that the printheads within the second row are operable to complete the print job notwithstanding that there is an inoperable printhead. For example, the second row of printheads may be operable for printing the print job notwithstanding a failure of a "cyan" printhead if cyan ink is not needed for the print job, or if there is more than one cyan printhead in the second row.

In an embodiment, a message is displayed to warn a user of a printhead failure and invite the user to choose among presented choices, including a choice to continue printing with operable printheads, upon detection of a printhead failure. As used in this specification a "display" may be a visual display, such as display via a monitor, projector, or other visual display device, and an auditory display of speech or non-speech output via an auditory display device. In embodiments, the presented choices may include a choice to stop printing, a choice to continue printing in the original mode notwithstanding the printhead failure, and a choice to continue printing utilizing the printheads in the second row and not the printheads in the first row. In an embodiment, printing may pause during the display of the message, and resumes when an instruction to continue printing with the operable printheads is received from a user. The instruction may be received via a user interface device such as a computer keyboard, mouse or touchpad.

In embodiments, the printheads in the first row continue to expel ink away from the media while the second row of printheads is being used in the second printing applying ink to the media to complete the print job. In such embodiments, a message may be displayed that warns a user that the choice to continue printing of the print job by applying ink to the media with less than all of the printheads can result in increased ink consumption as compared to normal printing using all printheads.

In an embodiment, the first printing and the second printing are both conducted utilizing a first plot calculated for the print job using the first printing. As used in this specification and the appended claims, a "plot" is a representation of an image converted to programming language and/or numerical form so that it can be stored and used in computing devices, servers, printers and other machines capable of performing calculations and manipulating data. As used in this specification and the appended claims, an "image" is a visual representation of an object, scene, person or abstraction (including text). The plot may include instructions as to how the image is to be printed. In embodiments, a plot may be expressed in a number of various languages and formats, including but not limited to HPGL/2 (Hewlett-Packard Graphics Language 2), PostScript, PDF (Portable Document Format), JPEG (Joint Photographic Experts Group standard), TIFF (Tagged Image File Format) and PCL3 (Printer Command Language 3).

In another embodiment, the first printing is conducted utilizing a first plot calculated for the first printing of the print job, and the second printing is conducted utilizing a second plot calculated for the second printing. In an embodiment, calculation of the second plot is caused to occur at a raster image processing component within the printer. In another embodiment, calculation of the second plot is caused to occur at a computing device, e.g., a printer management server, distinct from the printer.

Figure 2:
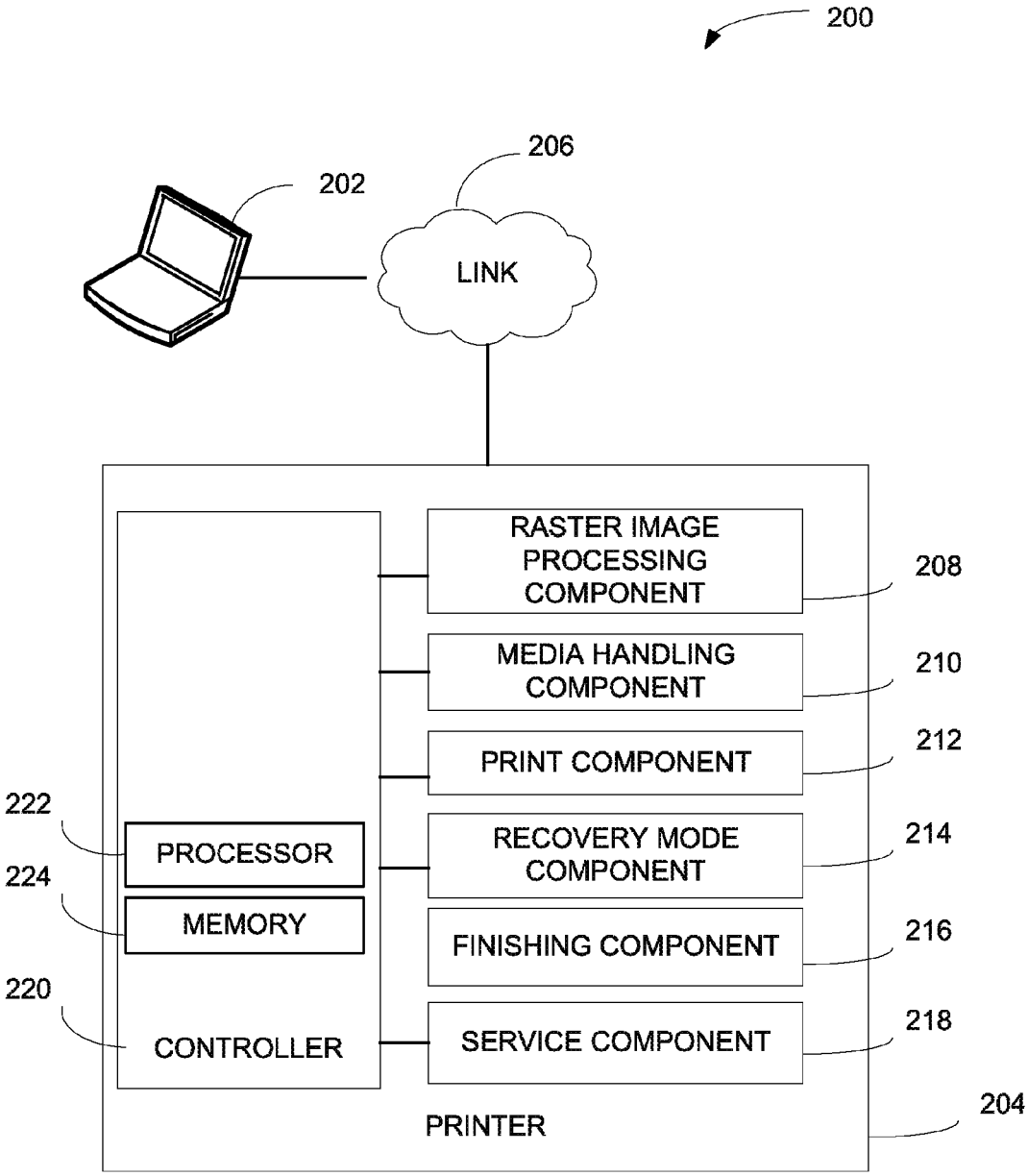
FIGS. 2 and 3 depict an example recovery mode component and an example recovery mode service according to embodiments.

Recovery mode manager 100 may be implemented in a number of environments, such as environment 200 of FIG. 2. Environment 200 is shown to include host computing device 202 and printer 204 interconnected via link 206.

Host computing device 202 represents generally any computing device capable of sending network requests to and otherwise communicating with printer 204. Host computing device 202 is capable of sending print jobs to and receiving information relating to the received print jobs and the printed output from, printer 204. Example implementations of host computing device 202 include a desktop computer, laptop computer, digital tablet computer, and the like.

Computing device 202 and printer 204 are interconnected via link 206. Link 206 represents generally one or more of a cable, wireless, fiber optic, or remote connection via a telecommunication link, an infrared link, a radio frequency link, or any other connectors or systems that provide electronic communication. Link 206 may include, at least in part, an intranet, the internet, or a combination of both. Link 206 may also include intermediate proxies, routers, switches, load balancers, and the like. The paths followed by link 206 between computing devices 202, and printer 204 as depicted in FIG. 2 represent the logical communication paths between these devices, not necessarily the physical paths between the devices.

Printer 204 represents generally any computing device operable to receive and process responses to requests to print content from host computing device 202 and to produce printed output. Printer 204 is capable of receiving print jobs from host computing device 202, and communicating information relating to the received print jobs and/or the printed output back to the host computing device 202. Printer 204 is shown to include a raster image processing component 208, media handling component 210, a print component 212, a recovery mode component 214, a finishing component 216, a service component 218, and a controller 220.

Returning to example printer 204, raster image processing component 208 represents generally any combination of hardware and software capable of converting digital information about fonts and graphics that describes the appearance of a desired image (e.g. information from a drawing or desktop publishing application) and translating that information into a plot composed of individual dots that printer 204 can output. In embodiments, a raster image processing component 208 composes a page layout. Media handling component 210 represents generally any combination of hardware and programming capable of transporting media through the printer 204. The media may be supplied for printing via a media roll, the media roll positioned within, or adjacent, to a housing of printer 204 during printing operations. Print component 212 represents generally any combination of elements capable of being utilized to form desired images on media. In a given example, print component 212 may include a fluid ejection mechanism, each fluid ejection mechanism including multiple printheads configured to dispense ink or other fluid. As used in this specification and the appended claims, "printhead" includes a mechanism having a plurality of nozzles through which ink or other fluid is ejected. Examples of printheads are drop-on-demand inkjet printheads, thermo resistive printheads, piezo and resistive printheads. Some printheads may be part of a cartridge which also stores the fluid to be dispensed. Other printheads are standalone and are supplied with fluid by an off-axis ink supply. Finishing component 216 represents generally any combination of hardware and programming capable of performing a finishing operation on media Such finishing operations include cutting, folding, laminating or any other action that affects the physical nature of the media. Service component 218 represents generally any combination of elements capable of being utilized to service print component 42. In an example, service component 218 may be configured to function as a spittoon and an alignment calibrator to service printheads.

Recovery mode component 214 represents generally any programming, that, when executed, implements the functionality of the recovery mode manager 100 of FIG. 1. In particular, recovery mode component 214, when executed by processor 222, is responsible for causing first printing upon a media in response to a print job, applying ink upon the media utilizing a first row and a second row of printheads. The first row of printheads includes a plurality of printhead types. The second row of printheads is adjacent to the first row, and includes at least one printhead of each of the types present in the first row. In an embodiment, after failure of a first printhead within the first row is detected utilizing a drop detector or other sensing device, the status of printheads included within the second row is analyzed. In other embodiments, the status of the second row of printheads may be determined in advance of, or concurrent with, the detection of the failure of the first printhead. After determining that the printheads within the second row are operable to complete the print job, a second printing is caused. The second printing is to continue printing of the print job, and utilizes the second row of printheads, and not the first row to apply ink upon the media.

In an embodiment, recovery mode component 214 is additionally configured to cause an exchange of a second printhead in the second row and a third printhead in the first row in response to detecting the second printhead is failed and that the third printhead is healthy and of the same type as the second printhead. Such an exchange can enable recovery mode printing to take place even in a situation where it is initially detected that the second row includes an inoperable printhead, by subsequently rendering the second row of printheads operable to complete the print job.

As used in this specification, controller 220 represents generally any combination of elements capable of coordinating the operation of components 208, 210, 212, 214, 216, and 218. In a given implementation, controller 220 includes a processor 222 and a memory 224. The processor 222 may represent multiple processors, and the memory 224 may represent multiple memories. In an embodiment, the controller 220 may include a number of software components that are stored in a computer-readable medium, such as memory 224, and are executable by processor 222. In this respect, the term "executable" includes a program file that is in a form that can be directly (e.g. machine code) or indirectly (e.g. source code that is to be compiled) performed by the processor 222. An executable program may be stored in any portion or component of memory 224.

Figure 3:
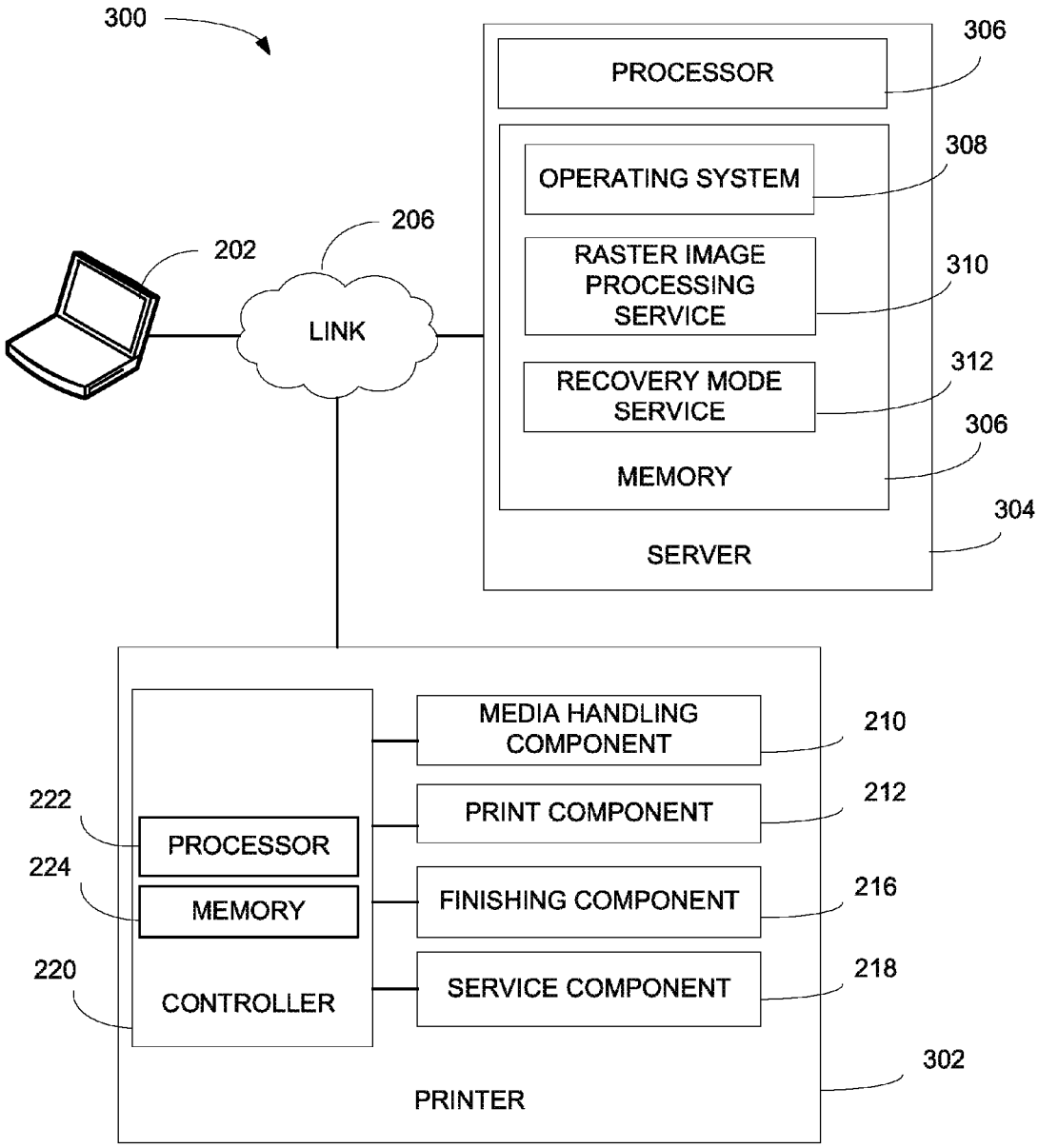

Recovery mode manager 100 may also be implemented in an environment such as environment 300 of FIG. 3. With the exceptions noted in this paragraph, the descriptions of the FIG. 2 computing device 202, printer 204, link 206, and any numerically referenced subcomponents, are to be applied to the FIG. 3 computing device 202, printer 302, link 206, and their numerically referenced subcomponents. Printer 302 represents generally a printer substantially similar to printer 204 of FIG. 2, except that printer 302 does not include a raster image processing component or a recovery mode component. Server 304 represents generally any computing device, or multiple computing devices, capable of receiving and responding to network requests from host computing device 202 and/or printer 302 via link 206. In an embodiment, server 304 may be a print management server operable to receive a print job from computing device 202 and in response cause printer 302 to produce printed output. Server 304 includes a recovery mode service 312, operable to cause first printing upon a media in response to a print job, the printing including applying ink upon a media utilizing a first row and a second row of printheads. The first row of printheads includes a plurality of printhead types. The second row of printheads is adjacent to the first row, and includes at least one printhead of each of the types present in the first row. A failure of a first printhead within the first row is detected utilizing a drop detector or other sensing device. Status of printheads included within the second row is analyzed. After determining that the printheads within the second row are operable to complete the print job, a second printing is caused. The second printing is to continue printing of the print job utilizing the second row of printheads, and not the first row of printheads, to apply ink upon the media. Server 304 additionally includes a raster image processing service 310 operable to process a second plot specific for the second printing of the print job at printer 302 to continue the print job.

In the foregoing discussion, various components were described as combinations of hardware and programming. Such components may be implemented in a number of fashions. In one example, the programming may be processor executable instructions stored on tangible memory media and the hardware may include a processor for executing those instructions. Thus, certain elements operating on the same device may share a common processor and common memory media.

Figure 4:
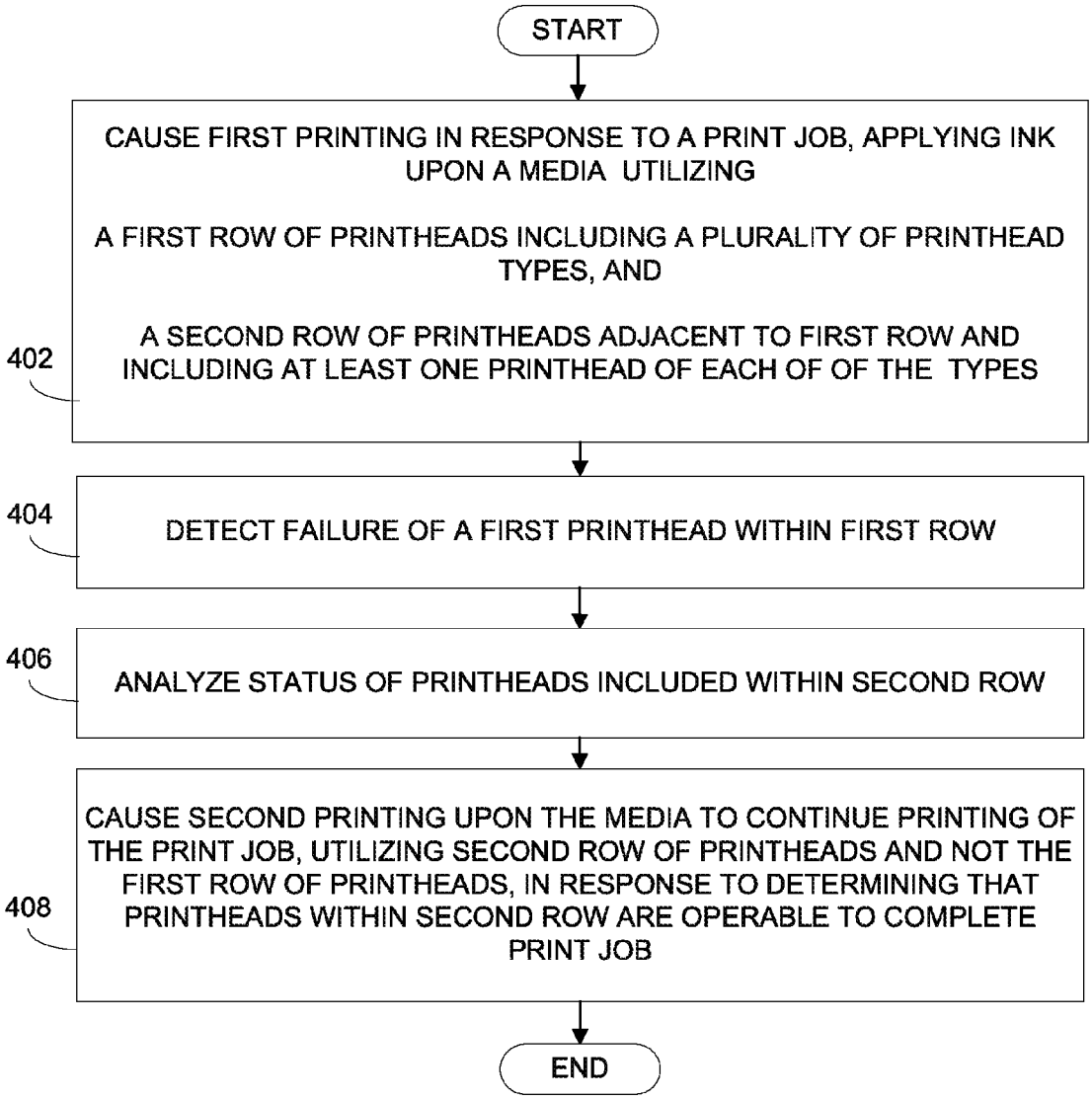
FIGS. 4 and 5 are example flow diagrams depicting embodiments of a method to print in a recovery mode.
Figure 5:
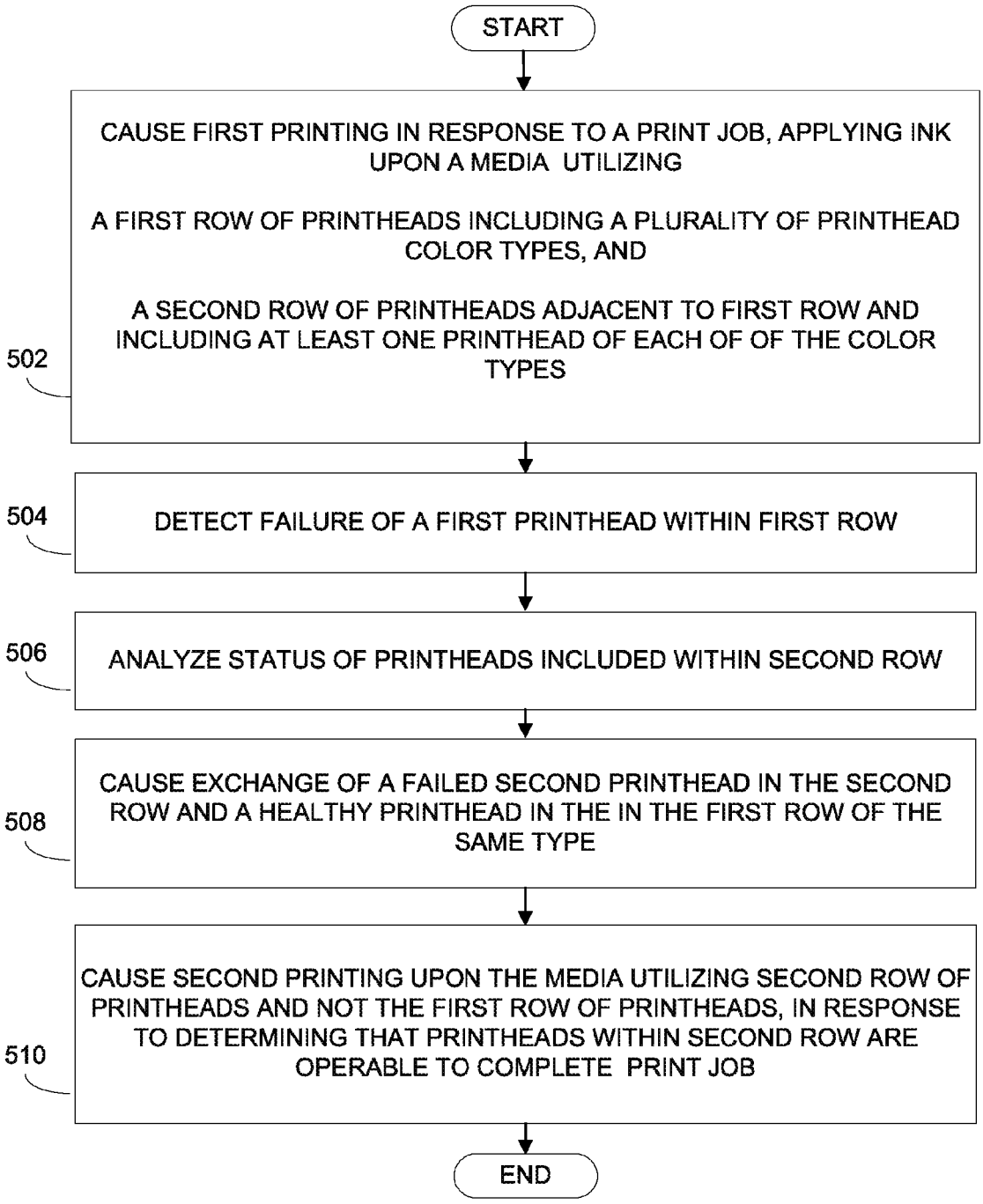

OPERATION: FIGS. 4 and 5 are flow diagrams depicting example embodiments of a method to print in a recovery mode. In discussing FIGS. 4 and 5, reference may be made to the diagrams of FIGS. 1-3 to provide contextual examples. Implementation, however, is not limited to those examples.

Starting with FIG. 4, first printing is caused in response to a print job. A first row of printheads and a second row of printheads apply ink upon a media during the first printing. The first row includes a plurality of printhead types. The second row is adjacent to the first row, and includes at least one printhead of each of the types (block 402). Referring back to FIG. 1, general printing module 102 may be responsible for implementing block 402.

Continuing with the flow diagram of FIG. 4, failure of a first printhead within the first row is detected (block 404). Referring back to FIG. 1, detection module 104 may be responsible for implementing block 404.

Continuing with the flow diagram of FIG. 4, status of printheads included within the second row is analyzed (block 406). Referring back to FIG. 1, printhead status module 106 may be responsible for implementing block 406.

Continuing with the flow diagram of FIG. 4, second printing upon the media to continue printing of the print job is caused. The second printing utilizes the second row of printheads, and not the first row of printheads, in response to determining that printheads within the second row are operable to complete the print job (block 408). Referring back to FIG. 1, recovery printing module 110 may be responsible for implementing block 408.

Moving on to FIG. 5, first printing is caused in response to a print job. A first row of printheads and a second row of printheads apply ink upon a media during the first printing. The first row includes a plurality of printhead color types. The second row is adjacent to the first row, and includes at least one printhead of each of the color types (block 502). Referring back to FIG. 1, general printing module 102 may be responsible for implementing block 502.

Continuing with the flow diagram of FIG. 5, failure of a first printhead within the first row is detected (block 504). Referring back to FIG. 1, detection module 104 may be responsible for implementing block 504.

Continuing with the flow diagram of FIG. 5, status of printheads included within the second row is analyzed (block 506). Referring back to FIG. 1, printhead status module 106 may be responsible for implementing block 506.

Continuing with the flow diagram of FIG. 5, in response to detecting that a second printhead in the second row is failed, and that a third printhead in the first row is healthy and of the same type as the second printhead, an exchange of the second and third printheads is caused (block 508). Referring back to FIG. 1, exchange module 108 may be responsible for implementing block 508.

Continuing with the flow diagram of FIG. 5, second printing upon the media is caused to continue printing of the print job. The second printing utilizes the second row of printheads, and not the first row of printheads, in response to determining that printheads within the second row are operable to complete the print job (block 408). Referring back to FIG. 1, recovery printing module 110 may be responsible for implementing block 510.

EXAMPLES

Figures 6A, 6B:
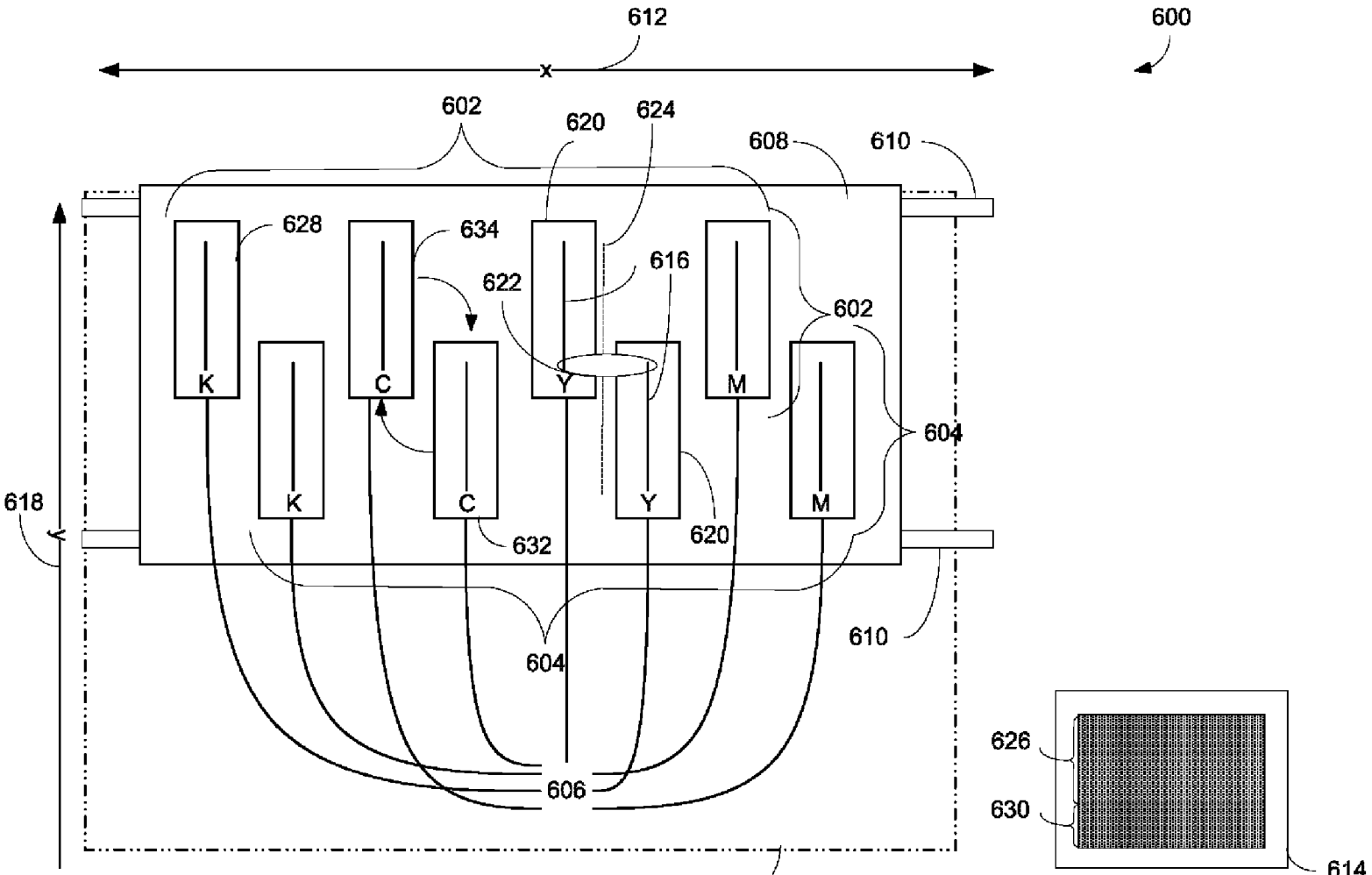
FIGS. 6A, 6B, and 7 illustrate examples of a recovery print mode, according to embodiments.

FIGS. 6A and 6B illustrate an example of a recovery print mode, according to an embodiment. FIG. 6A illustrates an example combined swath printhead configuration 600 that may be utilized during printing in a recovery mode. In this example a first row 602 and a second row 604 of printheads 606 are located on a same printhead carriage 608. The printhead carriage is movably mounted on slider rods 610 and configured to move, along an x axis 612, across a media 614 during a printing operation. In FIG. 6A the media 614 is depicted as transparent with a hashed line border in order to display example nozzle arrays 616 that emit ink upon the media 614. In this example, the media 614 may be moved along a y axis 618 during the printing process.

Each of the first row 602 and second row 604 includes printheads 606 of the color types black ("K"), cyan ("C"), yellow ("Y"), and magenta ("M"). In an embodiment, the yellow ("Y") type printheads 620 are positioned on the carriage 608 such that the nozzle array 616 of the yellow ("Y") printhead 620 of the first row 602 overlap 622 with nozzle array 616 of the yellow ("Y") printhead of the second row 604. This enables same color printing with a swath length approximately equal to the combined length 624 of the nozzle arrays 616.

A first printing 626 (FIG. 6B) is caused, in response to receipt of print job, applying ink upon the media 614 utilizing the first row 602 and adjacent second row 604 of printheads. Upon detection of a failure of a first black ("K") printhead 628 in the first row 602, the status of the printheads included within the second row 604 is analyzed. In response to determining that the printheads within the second row 604 are operable to complete the print job, a second printing 630 (FIG. 6B) is caused to continue the print job. The second row 604 of printheads, and not the first row 602 of printheads, is utilized to apply ink upon the media 614 to form the second printing 630 (FIG. 6B).

In an example, it may be detected that a second printhead 632, a cyan ("C") type printhead, in the second row 604 is failed, and that a third printhead 634 in the first row 602 of the same cyan ("C") color type is a healthy, i.e., operable printhead. An exchange of the second printhead 632 and the third printhead 634 is caused. This exchange enables recovery mode printing to take place by rending all of the printheads in the second row operable to complete the print job.

Figure 7:
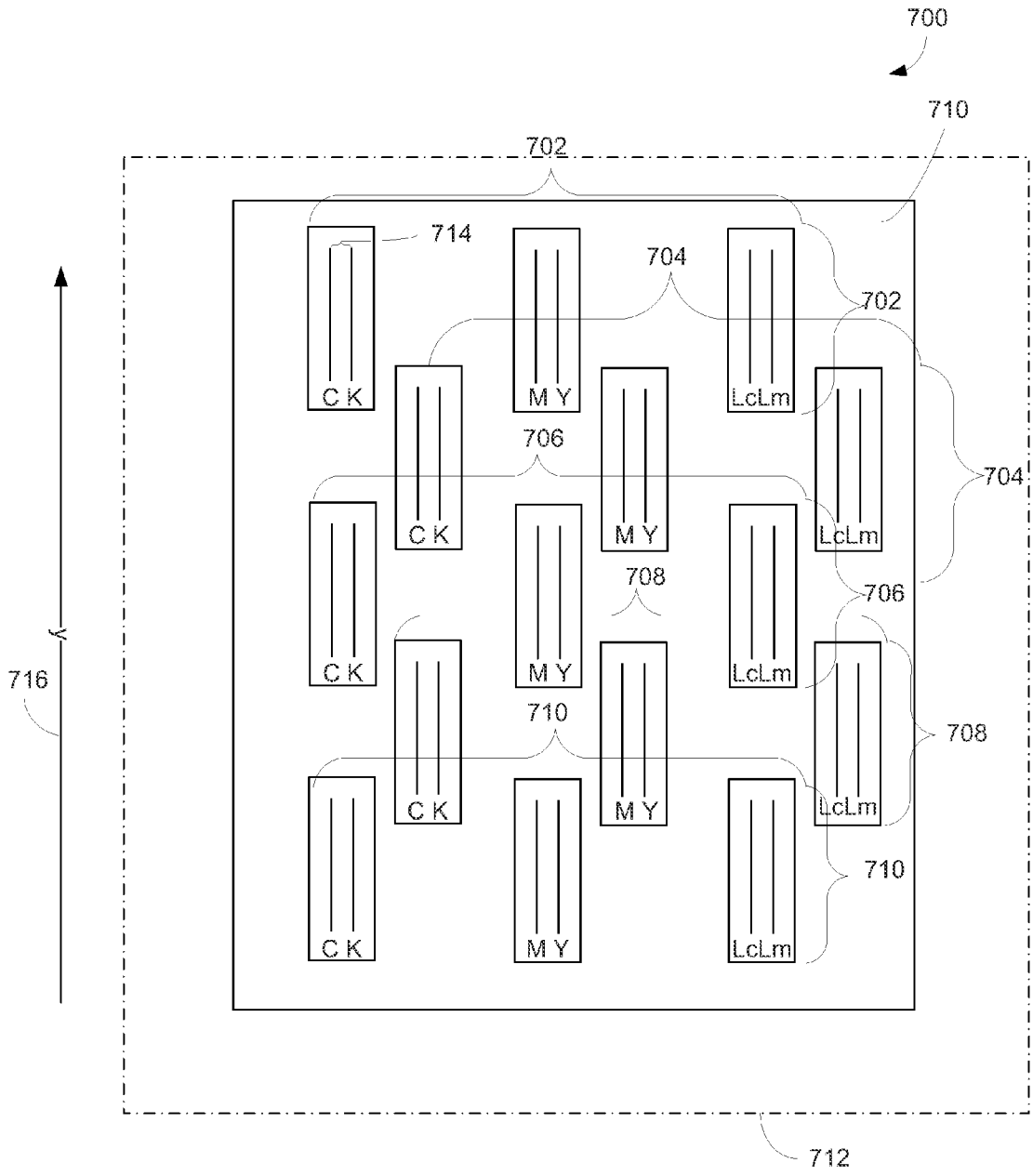

The disclosed print recovery mode is explained describing a first printhead row and a second printhead row. This is not intended to restrict the disclosure to a recovery print mode utilizing two printhead rows. This disclosure is equally applicable to print recovery mode utilizing any number of rows of printheads great than one. FIG. 7 illustrates an example printhead configuration 700 that may be utilized during printing in a recovery mode. In this example configuration a first row 702, second row 704, third row 706, fourth row 708 and fifth row 710 of printheads are located on a same stationary print bar 710. A media 712 is depicted as transparent with a hashed line border in order to display example nozzle arrays 714 that emit ink upon the media 712. In this example the media 712 may be moved along a y axis 716 during the printing process. Each of the first 702, second 704, third 706, fourth 708, and fifth 710 rows of printheads includes printheads of the color types cyan/black ("CK"), magenta/yellow ("MY") and light cyan/light magenta ("LcLm").

In an embodiment, a first printing is caused in response to a print job, applying ink upon the media 712 utilizing the first row 702 of printheads and the second 704, third 706, fourth 708 and fifth 710 rows of printheads adjacent to the first row 702. The second through fifth rows include at least one printhead of each of the types contained in the first row 702. Upon detection of a failure of a first printhead within the first row 702, the status of the printheads included within the second through fifth rows is analyzed. In response to determining that the printheads within the second, third, fourth and fifth rows are operable to complete the print job, a second printing 630 is caused to continue the print job utilizing the second 704, third 706, fourth 708 and fifth 710 rows, and not the first row 702, of printheads.

CONCLUSION: The diagrams of FIGS. 1-3 are used to depict the architecture, functionality, and operation of various embodiments. Implementation, however, is not so limited. Various components illustrated in FIGS. 1-3 are defined at least in part as programs. Each such component, portion thereof, or various combinations thereof may represent in whole or in part a module, segment, or portion of code that comprises one or more executable instructions to implement any specified logical function(s). Each component or various combinations thereof may represent a circuit or a number of interconnected circuits to implement the specified logical function(s).

Although the flow diagrams of FIGS. 4 and 5 show specific orders of execution, the order of execution may differ from that which is depicted. For example, the order of execution of two or more blocks may be scrambled relative to the order shown. Also, two or more blocks shown in succession may be executed concurrently or with partial concurrence. All such variations are within the scope of the present disclosure.

Also, the present disclosure may be embodied in any computer-readable media for use by or in connection with an instruction execution system such as a computer/processor based system or an ASIC (Application Specific Integrated Circuit) or other system that can fetch or obtain the logic from computer-readable media and execute the instructions contained therein. "Computer-readable media" can be any media that can contain, store, or maintain programs and data for use by or in connection with the instruction execution system. Computer readable media can comprise any one of many physical media such as, for example, electronic, magnetic, optical, electromagnetic, or semiconductor media. More specific examples of suitable computer-readable media include, but are not limited to, a portable magnetic computer diskette such as floppy diskettes or hard drives, a random access memory (RAM), a read-only memory (ROM), an erasable programmable read-only memory, or a portable compact disc.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A computer-readable storage medium containing instructions to print in a recovery mode that, the instructions when executed causing a computer to:

cause first printing in response to a print job, applying ink upon a media utilizing a first row of printheads including a plurality of printhead types, a second row of printheads adjacent to the first row including at least one printhead of each of the types;

detect failure of a first printhead within the first row;

analyze status of printheads included within the second row;

cause second printing applying ink upon the media utilizing the second row of printheads, and not the first row of printheads, in response to determining that printheads within the second row are operable to complete the print job.

2. The medium of claim 1, wherein it is determined that the second row has operating printheads including at least one of each of the types.

3. The medium of claim 1, wherein each printhead type emits ink of a different color.

4. The medium of claim 1, wherein the first and second rows of printheads are located on a same holding structure.

5. The medium of claim 4, wherein the holding structure comprises a printhead carriage.

6. The medium of claim 4, wherein the holding structure comprises a stationary print bar.

7. The medium of claim 1, wherein the second row of printheads includes printheads arranged in a same order as the first row according to type.

8. The medium of claim 1, wherein a nozzle array of a printhead of the first row overlaps with a nozzle array of a same type printhead of the second row.

9. The medium of claim 1, further comprising causing an exchange of a second printhead in the second row and a third printhead in the first row, the second and third printheads being of the same type, in response to detecting that the second printhead is failed and the third printhead is healthy.

10. The medium of claim 1, wherein determining that printheads within the second row are operable to complete the print job comprises determining that the second row has no inoperable printheads.

11. The medium of claim 1, further comprising receiving an instruction to continue printing with operable printheads.

12. The medium of claim 1, wherein the first printing is conducted utilizing a first plot calculated for the first printing and the second printing is conducted utilizing a second plot calculated for the second printing.

13. The medium of claim 1, further comprising causing calculation of the second plot.

14. A system to print in a recovery mode, comprising:

a general printing module, configured to cause first printing in response to a print job, applying ink upon a media utilizing a first row of printheads including a plurality of printhead types, a second row of printheads adjacent to the first row, including at least one printhead of each of the types;

a detection module, configured to detect failure of a first printhead within the first row;

a printhead status module, configured to analyze status of printheads included within the second row;

a recovery printing module, configured to cause second printing upon the media utilizing the second row of printheads, and not the first row of printheads, in response to determining that printheads within the second row are operable to complete the print job.

15. The system of claim 14, wherein each printhead type emits ink of a different color.

16. The system of claim 14, wherein the first and second rows of printheads are located on a same holding structure.

17. The system of claim 14, wherein a nozzle array of a printhead of the first row overlaps with a nozzle array of a same type printhead of the second row.

18. The system of claim 14, further comprising an exchange module configured to cause an exchange of a second printhead in the second row and a third printhead in the first row in response to detecting the second printhead is failed, the third printhead is healthy and of the same type as the second printhead.

19. A method to print in a recovery mode, comprising:

causing first printing upon a media in response to a print job, applying ink upon a media utilizing a first row of printheads including a plurality of printhead color types, a second row of printheads adjacent to the first row, including at least one printhead of each of the color types, wherein a nozzle array of a printhead of the first row overlaps with a nozzle array of a same color type printhead of the second row;

detecting failure of a first printhead within the first row;

analyzing status of printheads included within the second row;

receiving an instruction to continue printing with operable printheads;

cause second printing upon the media utilizing the second row of printheads, and not the first row of printheads, in response to determining that printheads within the second row are operable to complete the print job.

20. The method of claim 19, further comprising causing an exchange of a second printhead in the second row and a third printhead in the first row, the second printhead being of the same color type as the third printhead, in response to detecting that the second printhead is failed and the third printhead is healthy.

* * * * *